US005720440A

United States Patent [19]

Bonner et al.

[11] Patent Number: 5,720,440

[45] Date of Patent: Feb. 24, 1998

[54] COVER ROTATING DRUM GRINDING MACHINE

[75] Inventors: Carl L. Bonner; Melvin A. Zehr, both of Middleton, Id.

[73] Assignee: Diamond Z Manufacturing, Nampa, Id.

[21] Appl. No.: 625,764

[22] Filed: Mar. 29, 1996

[51] Int. Cl.[6] ..... B02C 13/286

[52] U.S. Cl. ..... 241/101.761; 241/186.35; 241/186.4

[58] Field of Search ..... 241/101.761, 186.4, 241/186.35, 285.2, 285.3

[56] References Cited

U.S. PATENT DOCUMENTS

| | | | |
|---|---|---|---|
| 1,840,749 | 1/1932 | Stesau | 241/186.35 X |
| 2,226,330 | 12/1940 | Symons | 241/186.35 |
| 3,483,906 | 12/1969 | Moeller | 241/186.35 X |
| 4,448,361 | 5/1984 | Marcy | 241/101.761 |
| 4,449,673 | 5/1984 | Cameron | 241/186.35 |
| 4,846,411 | 7/1989 | Herron et al. | 241/186.4 X |
| 4,997,135 | 3/1991 | Zehr | 241/101.7 |
| 5,375,784 | 12/1994 | Worley | 241/101.761 X |
| 5,419,502 | 5/1995 | Morey . | |
| 5,590,842 | 1/1997 | Zehr | 241/186.35 |

*Primary Examiner*—Mark Rosenbaum
*Attorney, Agent, or Firm*—Frank J. Dykas

[57] ABSTRACT

A covered rotating drum grinding machine having a frame, engine assembly and hammermill assembly mounted to the frame is provided. Sitting atop of the hammermill assembly is a rotating drum assembly, which is used to agitate and feed material to be ground into the hammermill assembly. A stationary drum assembly, including an infeed opening through which material to be ground is passed, is provided atop the rotating drum assembly to prevent material impacting the hammermill or other grinding device from being propelled out of the enclosed drum space on a ballistic trajectory.

13 Claims, 7 Drawing Sheets

COVER ROTATING DRUM GRINDING MACHINE

BACKGROUND OF THE INVENTION

1. Technical Field

This invention generally relates to grinders, and more particularly to a covered rotating drum grinder having a system infeeding material to be ground into an enclosed drum assembly above a rotating drum assembly.

2. Background

Grinding machines, including those using hamermills, drum chippers and wheel chippers, are used for varying applications. These applications can include, amongst others: grinding tree stumps and slash from logging operations; construction debris from buildings damaged by natural disaster, such as hurricanes or floods; grinding apples for apple juice; and grinding landfill garbage and tires for compaction purposes. The typical hammermill is formed of a rotatable shaft to which radially extending hammers are affixed, all interfitted within a semi-circular hammermill screen. The material to be ground is dropped, usually into a hopper from which it passes into the rotating hammers where it is broken apart or pulverized. The hammermill screen serves as a sieve, allowing ground material smaller than the predetermined sieve hole size of the hammermill screen, to pass through, or literally to be thrown through, the screen into a chute and onto some sort of discharge system, conveyor, auger or other device by which it is carried away.

Drum chippers are generally cylindrical drums to which knives are attached. Wheel chippers are typical circular disks with extending cutting edges. All can be used to grind most types of material.

In some applications, a stationary hopper adequately serves as a feed hopper for the material to be ground. This is particularly true in applications where the material to be ground flows freely or rolls, and is of relatively uniform size. For example, a stationary hopper works well for grinding apples to form a mash from which apple juice is extracted. In other applications, where the material to be ground is of irregular shape or size such that it does not freely flow through a hopper, rotating tubs are used in lieu of a stationary feed hopper, so as to agitate the material to prevent jamming and to assist in passing the material to be ground into the grinder. The rotating drums are also used where the material to be ground is of particularly large size, to the extent that it will not itself drop into the grinder assembly, but rather must be continuously or intermittently fed into the grinder assembly a portion at a time. Size and/or volume reduction of input product, for example, my U.S. Pat. No. 4,997,135 discloses a rotating tub grinding machine which was primarily designed for use with tree stumps and slash removed during logging/land clearing operations. In the grinding machine disclosed in U.S. Pat. No. 4,997,135, large tree stumps are dropped into a rotating tub where, because of the rotation of the tub, they are continuously passed over the top of a hammermill where pieces of the stumps can be hammered off by the hammermill hammers for grinding. Likewise, the rotating tub agitates the slash and thereby keeps it from bridging the opening into the hammermill.

The problem with prior art rotating tub grinders is that the material to be ground has to be dropped into the rotating drum through an open top. The material is dropped in either by use of a conveyor, front-end loader, track or shovel. These are high capacity machines. For example, the rotating tub grinder disclosed in my U.S. Pat. No. 4,997,135 can easily be used to grind up to 60 tons per hour of tree stumps and slash, or even normal domestic landfill garbage.

The problem with feeding tub grinders from the top is that the rotating hammers, or knives, as they impact the material to be ground, do not necessarily always drive it into the grinder assembly. Pieces of material impacted by the hammers or knives can be propelled in virtually any direction, including against the side walls of the rotating tub from where it can ricochet out of the tub, or even straight up and out of the tub. When grinding tree stumps, wood slash, building materials, or landfill garbage, it is not uncommon to have pieces of material turn into projectiles traveling away from the tub on ballistic trajectories. For this reason, in prior art designs, it has been a significant design consideration as to where to place the operating controls, or to provide remote cable or radio frequency operated controls, so that the operator can stand at a safe distance from the machine during its operation.

In other applications, for example grinding domestic landfill garbage, dust and air pollution can be a problem with the open-top rotating tub grinder.

Unfortunately, with prior art rotating tub grinders, there is no other way to drop material into the tub except into the open top.

Landfill operations could greatly benefit from the use of rotating tub grinding machines. Stationary hoppers do not work well with standard landfill material, and will frequently bridge or jam. A rotating tub grinder will work better, except for the potential of pieces of material impacted by the hammers or knives becoming projectiles. And, the dust and the particulate matter released into the atmosphere is a consideration. On the plus side, if a rotating grinder is used in landfill operations, it results in compaction rates for typical landfill garbage in the range of approximately four-to-one, thus extending the service life of the landfill, also, because of the more homogeneous nature of the ground landfill debris, there is less need to quickly cover the exposed garbage with dirt to prevent scavenging rodents and birds from feeding upon it, as well as potential health hazards.

Accordingly, it is an object of the present invention to provide a rotating drum grinding machine which features a closed stationary drum through which material to be ground can be fed into the rotating drum assembly without danger of partially ground material being turned into potentially dangerous projectiles.

It is another object of the present invention to provide a rotating drum grinder with a stationary covered drum through which also serves as a dust barrier to reduce or prevent particulate air pollution.

DISCLOSURE OF INVENTION

These objects are achieved in a covered rotating drum grinding machine having, in a preferred embodiment, a stationary or trailerable frame, an engine assembly, a hammermill assembly positioned underneath a horizontal plane defined by the frame, mounted to the frame atop the horizontal plane is a rotating drum assembly which itself is covered by a stationary drum assembly. The stationary drum assembly includes an infeed opening through which material to be ground is passed into a generally enclosed drum space defined between the stationary drum assembly and the rotating drum assembly. Material to be ground is passed through the infeed opening by means of a feed conveyor, and a conveyor shroud is provided for safety purposes to prevent random projectiles propelled by impaction with the hammermill assembly from escaping the enclosed drum space on a ballistic trajectory.

Ground material passing through the cutting assembly drops onto a primary output discharge system from where it is conveyed to a secondary output conveyor and out into a pile or a waiting dump truck.

The hammermill assembly is formed of a hammermill shaft mounted to bearing blocks and driven by drive shaft interconnected by conventional means to the engine assembly. Affixed to the shaft are hammermill rings which are provided with radially aligned pin holes. Hammers are provided with corresponding pin holes and interfit between the hammermill rings with pin holes aligned. Pins are then inserted through the pin holes to lock the plurality of hammers to the hammermill assembly. Hammers are provided with replaceable hammer tips.

In the preferred embodiment, the hammermill assembly is positioned beneath the horizontal plane defined by the frame and beneath an opening in a stationary bottom plate of the rotating drum assembly.

The rotating drum assembly is formed of a stationary support wall affixed to the stationary bottom plate. The bottom plate includes an opening which is positioned in alignment with the top of the hammermill assembly and through which material to be ground passes. The stationary support wall supports and holds in alignment a rotating side wall by means of horizontal and vertical roller assemblies. Power to drive the rotating side wall is provided by a hydraulic motor having an attached drive sprocket, and a bull sprocket gear attached to the outside of the rotating side wall, both interconnected by means of a chain assembly.

The rotating drum assembly defines an interior rotating drum space. The rotation of the rotating wall serves to agitate and move the material to be ground, passing it into the opening of the hammermill, or, if the material is too large to pass through the opening, then into engagement with the hammermill assembly wherein pieces of the material can be broken off and ground.

A stationary drum assembly is provided. The stationary assembly has stationary sidewalls and a top cover and is held in position above the rotating drum assembly by means of support brackets.

The stationary sidewall is provided with an infeed opening through which an infeed conveyor interfits so that material to be ground, carried on the infeed conveyor, is dropped into a generally enclosed drum space defined by and between the rotating drum assembly and the stationary drum assembly.

The covered rotating drum grinding machine is provided with a drum tilting feature to facilitate maintenance and clean out of the machine. The infeed conveyor assembly and the stationary drum assembly are interconnected to provide the tiltable feature which enables the operator to tilt the assembly sideways so as to tilt up and away the rotating drum assembly, thus exposing the interior of the rotating drum assembly for purposes of maintenance and clean out. The rotating drum assembly is also hinged and tiltable away from the bottom plate and the hammermill assembly, thus exposing the hammermill assembly for purposes of maintenance and clean out.

BEST MODE FOR CARRYING OUT INVENTION

Figure 1:
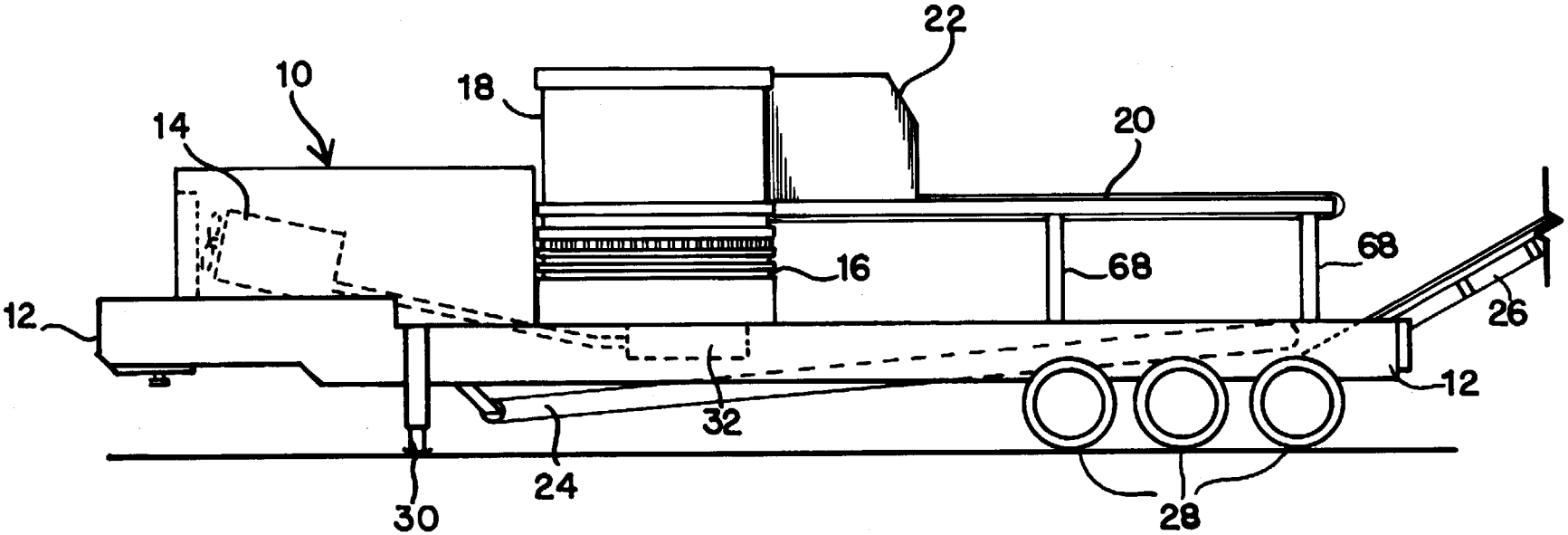
FIG. 1 is a simplified representational side view of the covered grinding apparatus.

Referring first to FIG. 1, the basic sub-assemblies of the covered grinding apparatus 10 are shown in representational format. It is shown in a trailerable configuration utilizing frame 12, wheel and axle assemblies 28, and leveling jacks 30. In this configuration, the machine, which is comparable in size to a large tractor trailer, can be towed from one location to another. Attached to frame 12 is engine assembly 14, which, in the typical configuration, will be a powered unit producing at least 100 hp and up. It is operably connected by conventional and well-known drive and clutch means to hammermill assembly 32, which is positioned underneath the horizontal plane defined by frame 12.

Figure 2:
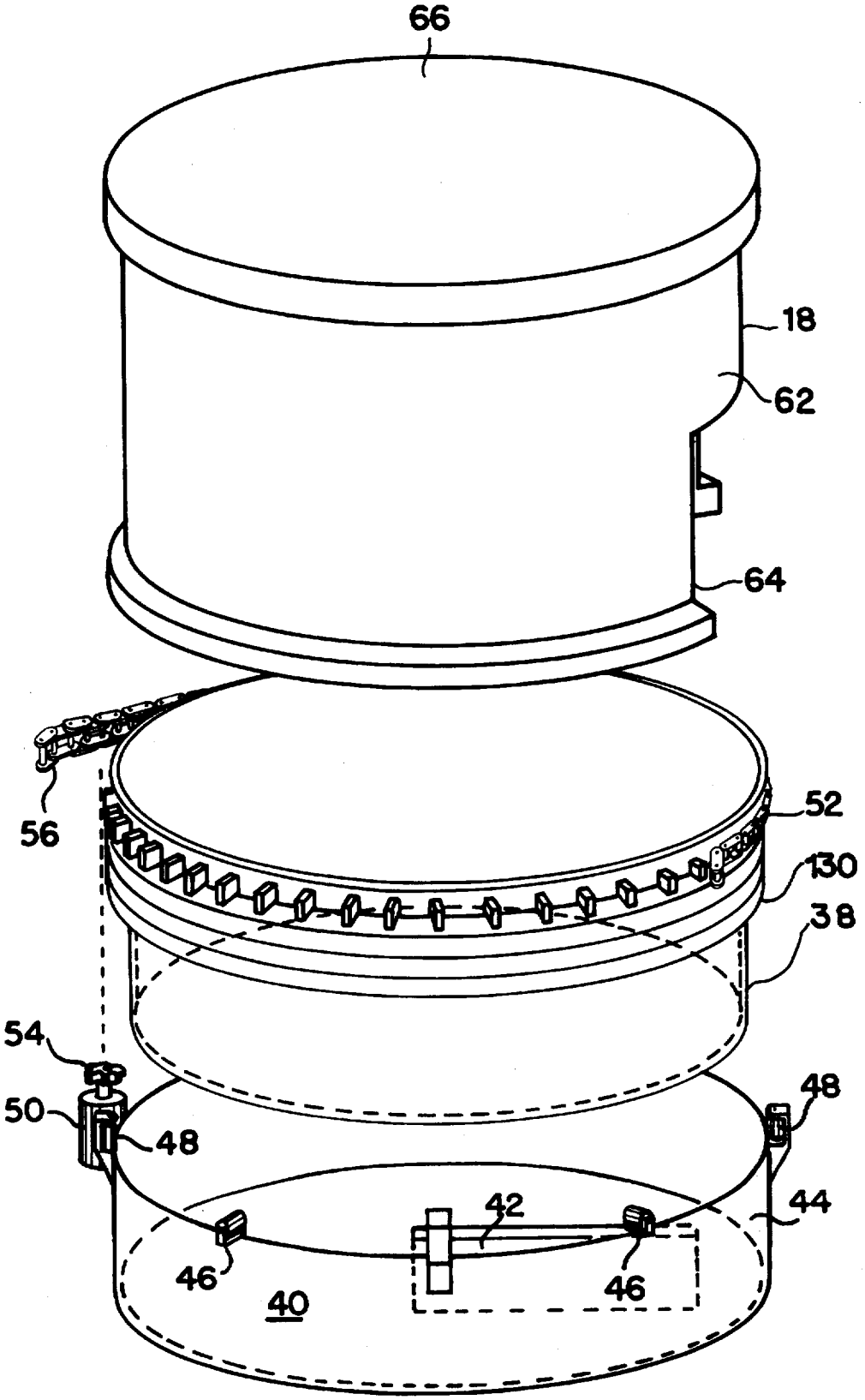
FIG. 2 is an exploded perspective representational view of the rotatable drum assembly and stationary drum assembly.
Figure 3:
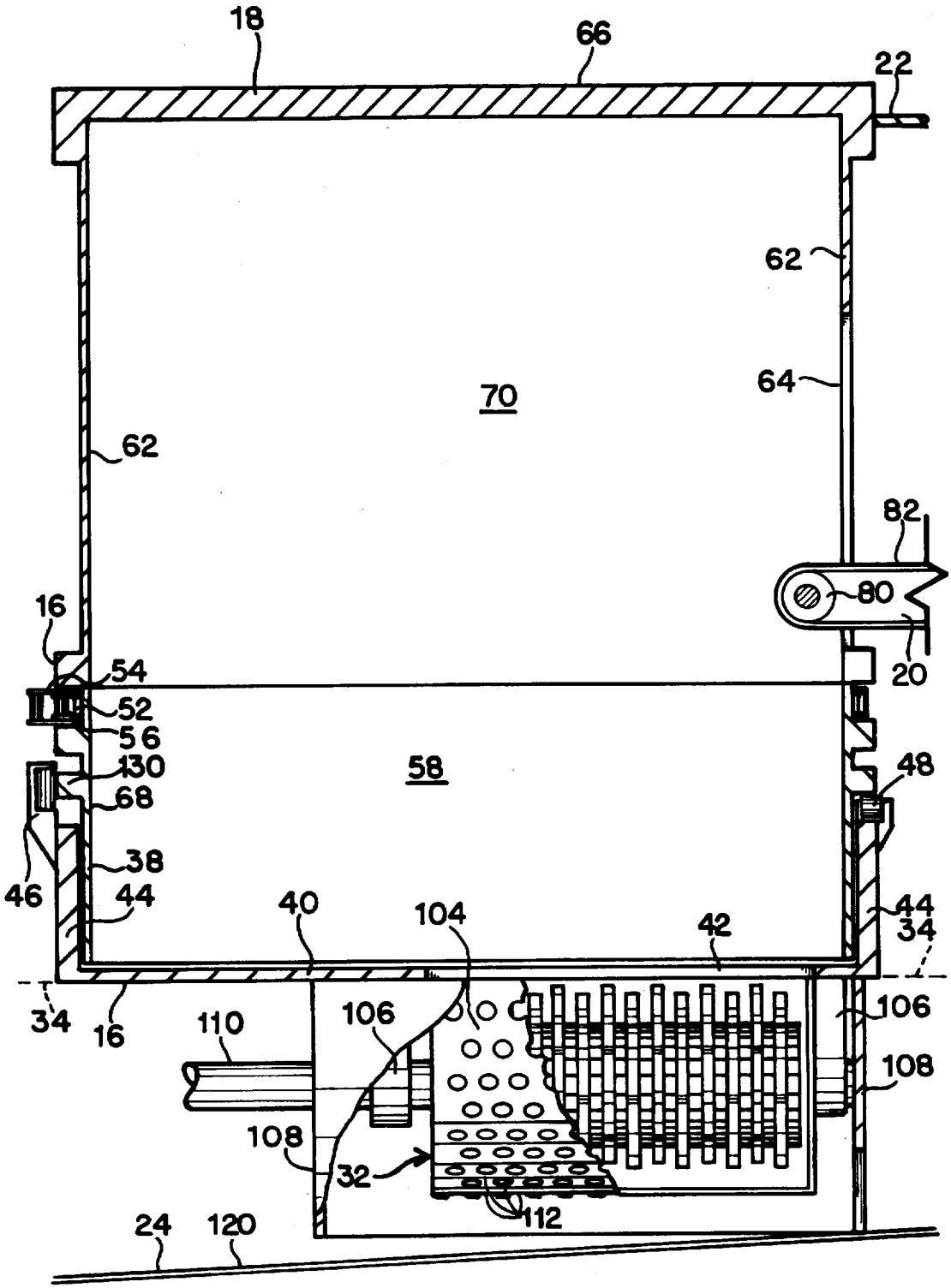
FIG. 3 is a sectional representational side view of the rotatable drum assembly, stationary drum assembly, and hammermill assembly.

Mounted atop the horizontal plane defined by frame 12 is a rotating drum assembly 16, which itself is covered by stationary drum assembly 18. Stationary drum assembly 18 includes infeed opening 64, as shown in FIGS. 2 and 3, through which material to be ground is passed into a generally enclosed drum space defined between the stationary cover assembly 18 and the rotatable drum assembly 16. Material to be ground is carried through infeed opening 64 by infeed conveyor 20. As shown in FIG. 1, a conveyor shroud 22 is provided for safety purposes to prevent random projectiles propelled by impaction with the hammermill assembly 32 from escaping on a ballistic trajectory from the enclosed drum space.

Ground material passing through the hammermill assembly drops on to primary output conveyor 24 from where it is conveyed to secondary output conveyor 26 and out into a pile or into a waiting dump truck.

While the preferred embodiment is a trailerable configuration, it should be apparent to those skilled in the art that the covered grinding machine can be adapted to a variety of other configurations, including a stationary system or, in smaller applications, to a direct truck chassis mounted system.

Also, in this best mode section, the preferred embodiment is disclosed as a grinding apparatus which utilizes a hammermill assembly. However, it should be distinctly noted and pointed out that the principles of this invention apply equally well to any grinding machine employing other types of grinding assemblies, such as drum chippers, which are cylindrical drums with extending knives, and wheel chippers, which are circular disks employing extending cutting blades. It should be distinctly understood that the claimed invention is not limited to grinding machines that only employ hammermill assemblies.

Figure 4:
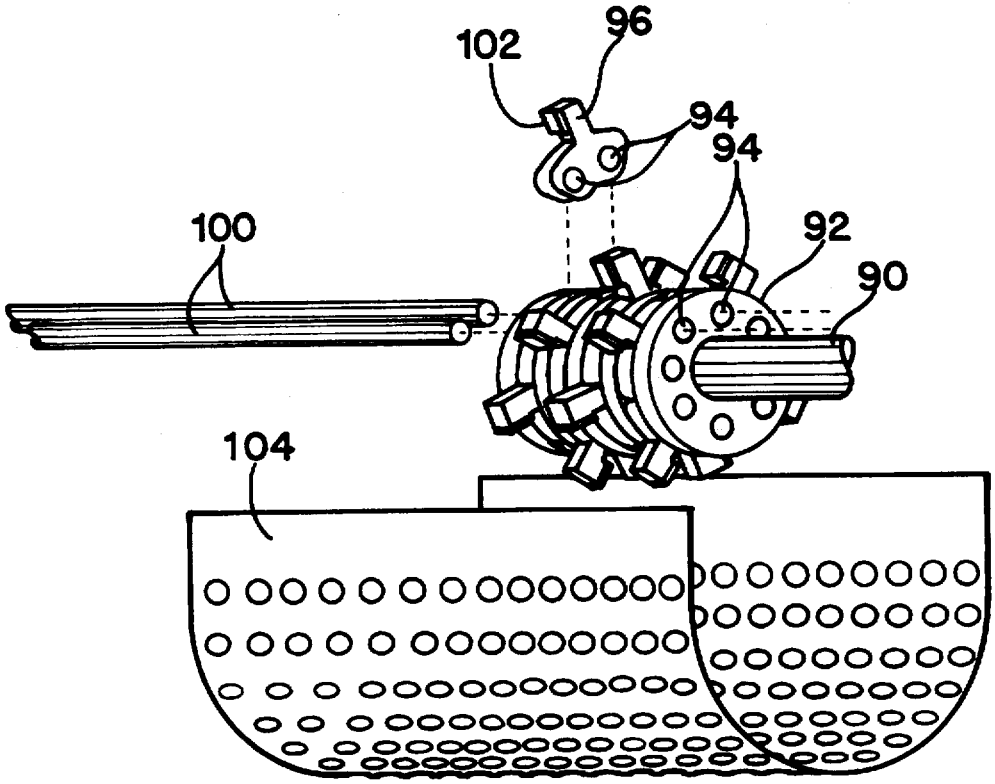
FIG. 4 is a partial, exploded, perspective representational view of the hammermill assembly.
Figure 5:
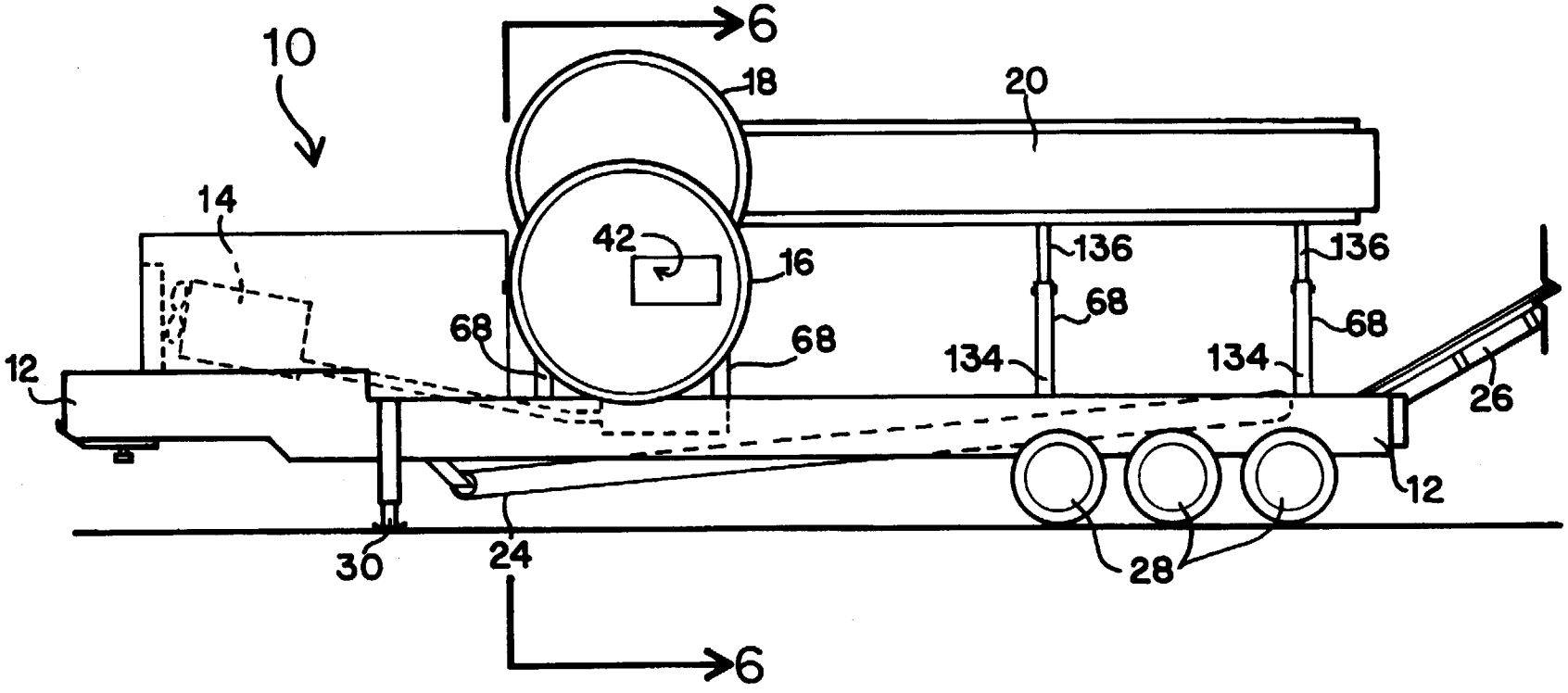
FIG. 5 is a simplified representational side view of the covered grinding apparatus.
Figure 6A:
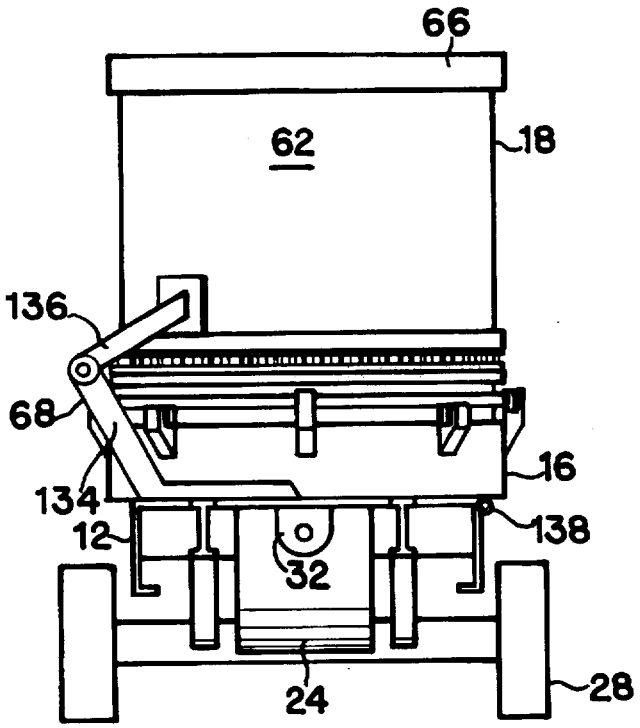
FIG. 6A is a representational front view of the rotatable drum and stationary drum assemblies in a closed, operating position taken along plane 6—6 of FIG. 5.
Figure 6B:
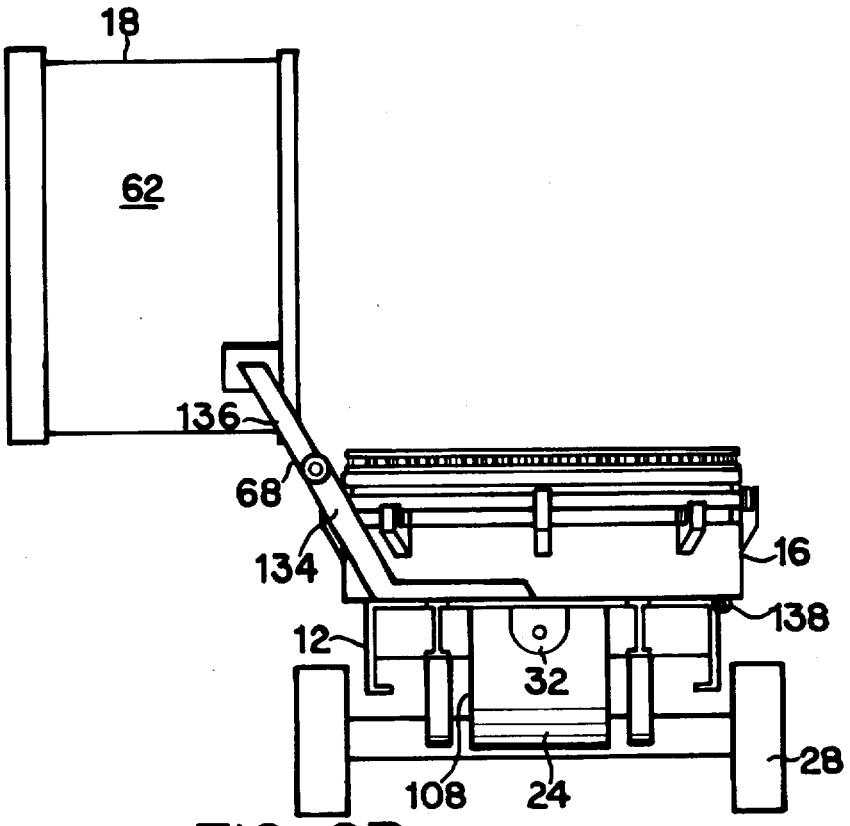
FIG. 6B is a representational front view of the rotatable drum and stationary drum assemblies with the stationary drum in a tilted, clean-out position, taken along the plane 6—6 of FIG. 5.
Figure 6C:
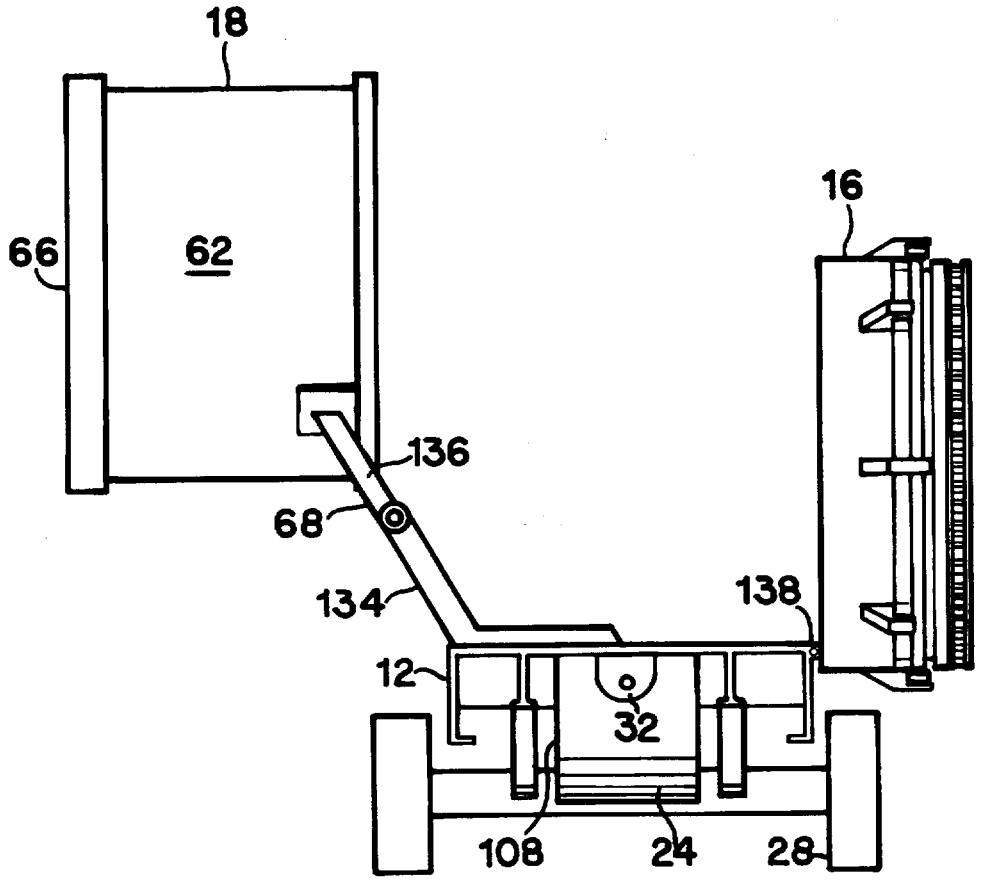
FIG. 6C is a representational front view of the rotatable drum and stationary drum assemblies with both the rotatable drum and stationary drum assemblies in a tilted, clean-out position taken along plane 6—6 of FIG. 5.

The hammermill assembly 32, as shown in FIGS. 3 and 4, is formed of hammermill shaft 90 mounted to bearing blocks 106, and driven by drive shaft 110, which itself is interconnected by a clutch in some fashion to engine assembly 14. Affixed to the shaft are hammermill rings 92, which are provided with radially aligned pin holes 94. Hammers 96 are provided with corresponding pin holes 94 and interfit between hammermill rings 92, with pin holes 94 aligned between adjacent hammermill rings 92. Pins 100 are then inserted through pin holes 94 to lock a plurality of hammers 96 to the hammermill assembly 32.

In the preferred embodiment, hammers 96 are provided with replaceable hammer tips 102 which, of course, are a wear item and need to be periodically replaced. Hammer tips 102 are attached to hammers 96 by conventional and well-known means, which include welding and/or bolting hammer tips 102 to hammers 96.

In the preferred embodiment, hammermill assembly 32 is positioned beneath horizontal plane 34 which is shown representationally in FIG. 3 beneath opening 42 in stationary bottom plate 40, which is affixed to rotating drum assembly 16 so as to be tiltable with rotating drum assembly 16 as later described. Depending upon the design of the hammermill assembly 32, the hammermill assembly 32 can be positioned such that hammer tips 102 attached to radially extending hammers 96, and the extended portion of hammer 96, can be positioned just up to, but not through, opening 42, or, through opening 42 or in some designs below it. These are design considerations which are often times empirically determined and are, in part, dependent upon the size and mass of the hammermill shaft 90, rings 92 and hammers 96.

Material to be ground drops through opening 42 where it is impacted by hammer tips 102 and broken into pieces which eventually pass through screen holes 112 formed in hammermill screen 104. The hammermill assembly 32 is encased within shroud 108, which is open at the bottom, such that ground material passing through holes 112 of hammermill screen 104 drop on to primary output conveyor belt 120 of primary output conveyor 24, from where they are carried away from the machine and on to, in the preferred embodiment, secondary output conveyor 26.

The rotating drum assembly is formed of stationary support wall 44 affixed to stationary bottom plate 40, which, as previously stated, includes opening 42 which is positioned in alignment with the top of hammermill assembly 32. The stationary support wall 44 supports and holds in alignment rotating side wall 38 by means of horizontal roller assemblies 46 and vertical roller assemblies 48. Ledge 130 of rotating side wall 38 rides atop horizontal rollers 46 and within vertical side rollers 48 to support and maintain alignment of rotating side wall 38 as it rotates within stationary support wall 44.

Power to drive the rotating side wall 38 is provided by hydraulic motor 50, which, in the preferred embodiment, is a reversible hydraulic motor, such that rotating side wall 38 can be rotated in one direction, and then reversed for rotation in another in the event of a jam, or to clear the machine.

Drive sprocket 54, attached to hydraulic motor 50, interconnects through drive chain 56 and to bull sprocket gear 52 attached to rotating side wall 38 to complete the rotation drive assembly.

The rotating drum assembly 16 defines interior rotating drum space 58 as shown in FIG. 3. The rotation of rotating wall 38 serves to agitate and move the material to be ground, passing it into opening 42, or if the material is too large to pass through opening 42, then into engagement with the hammermill assembly 32 wherein pieces of the material are broken off and ground.

Stationary drum assembly 18, as shown in FIGS. 1, 2, 3, 6A, 6B and 6C is formed of stationary side wall 62, top cover 66 and is held in position above rotating drum assembly 16 by means of a plurality of stationary drum hinge assemblies 68, which are welded or bolted to frame 12 and to both stationary side wall 62 and infeed conveyor assembly 20 by conventional and well-known means. Hinge assemblies 68 are formed of fixed brackets 134 which are welded or otherwise affixed to the frame, and hinge arms 136. Hinge assemblies 68 interconnect between frame 12 and both stationary drum assembly 18 and infeed conveyor assembly 20, so as to provide a tiltable feature to tilt open stationary drum assembly 18 so that a clean-out feature, as later described, is provided. It should be pointed out that there are a number of other methods of positioning and holding stationary drum assembly 18, all of which are conventional and well known.

Stationary side wall 62 is provided with infeed opening 64 through which infeed conveyor 20 interfits so that material to be ground, carried by infeed conveyor 82, drops into the generally enclosed drum space formed of stationary drum space 70 and rotating drum space 58, as infeed conveyor 82 rotates around infeed conveyor sprocket 80.

In practice, material impacting hammermill assembly 32 flies in every direction within the enclosed drum space defined by rotating drum space 58 and stationary drum space 70. Some of it may pass back out through infeed opening 64, in which case it impacts upon drum opening shroud 22 and drops back on to infeed conveyor belt 82 and is returned to the enclosed drum space.

Occasionally there will be a need for maintenance, or to clean out the enclosed drum space and the hammermill assembly, particularly in the event that the hammermill assembly 32 is plugged during grinding operations. To facilitate maintenance and clean out, the infeed conveyor assembly 20, and the stationary drum assembly 18 are interconnected and provided with a tiltable feature which enables the operator to tilt these entire assemblies sideways so as to tilt up and away from rotating drum assembly 16. Rotating drum assembly 16 is also provided with a tiltable feature so as to enable it to be tilted up and away from stationary bottom plate 40 and from hammermill assembly 32, thus fully exposing hammermill assembly 32 for purposes of clean out or periodic maintenance. This is accomplished, as representationally shown in FIGS. 5 and 6A, 6B and 6C. As previously stated, stationary drum assembly 18 and infeed conveyor 20 are interconnected and hinged by means of hinge assembly 68 to provide for a tiltable feature which enables the operator to tilt stationary drum assembly 18 and infeed conveyor assembly 20 up and away from frame 12, so as to facilitate clean out. In a like manner, rotating drum assembly 16 is hinged by means of hinge assemblies 138 so as to enable it to be tilted up and away in the opposite direction from that of stationary drum assembly 18, thus exposing hammermill assembly 32 and primary output conveyor assembly 24 for purposes of both maintenance and clean out. In the preferred embodiment both tilt out features are hydraulically operated by means of hydraulic rams, not shown, but which are well known in the art, and play no part in this invention.

It should be pointed out that there are other ways of providing access to the rotating drum assembly 16 and hammermill assembly 32 for purposes of clean out and maintenance which include providing for a removable top cover 66 which is either hinged and hydraulically operable to swing open, or simply bolted in place, or provided with a breach lock assembly. In addition, the entire stationary drum assembly can simply be bolted by means of brackets to frame 12, or brackets for a breach lock assembly to frame 12. Or, the entire assembly, including the stationary drum assembly 18 and rotating drum assemblies 16 can be tiltable as a single unit to either front, back, one side or the other. All that is required is that access be gained somehow to the hammermill assembly and the rotating drum assembly for purposes of clean out and maintenance.

While there is shown and described the present preferred embodiment of the invention, it is to be distinctly understood that this invention is not limited thereto but may be variously embodied to practice within the scope of the following claims.

We claim:

1. An apparatus for grinding material which comprises:

a frame;

material grinding means mounted to said frame;

drive means operatively connected to said grinding means;

a rotatable drum assembly having a rotatable side wall, a stationary bottom surface, and being open at the top, and defining therein a rotating drum space, said bottom surface having an opening therethough for the passage of material to be ground, said rotatable drum attached to the frame in a position for alignment of the opening in said bottom surface with the grinding means for the passage of material to be ground into the grinding means;

means for rotating said rotatable side wall;

a stationary drum assembly having a stationary side wall, a top cover, and open at the bottom, and defining therein a stationary drum space, attached to the frame and positioned atop the rotatable drum assembly to define a generally enclosed drum space between the stationary drum assembly and the rotatable drum assembly, said stationary drum side wall having at least one infeed opening therethrough for the passage of material to be ground into the generally enclosed drum space;

infeed conveying means for conveying material to be ground through the opening in the stationary drum side wall and into the generally enclosed drum space when the drive means is operating the grinding means and the means for rotating is rotating the rotatable side wall; and discharge means positioned below the grinding means for collection and conveyance of ground material from the grinding means.

2. The apparatus for grinding material of claim 1 wherein said material grinding means further comprises a hammermill assembly for grinding material, said hammermill assembly having a rotatable hammermill with extending hammers, and a hammermill screen positioned below the rotatable hammermill, attached to the frame.

3. The apparatus for grinding material of claim 1 which further comprises means for tilting the rotatable drum and stationary drum assemblies from a vertical position to a tilted position.

4. The apparatus for grinding material of claim 1 which further comprises means for shrouding the infeed opening to prevent material from passing out from the generally enclosed drum space from following a ballistic trajectory.

5. The apparatus for grinding material of claim 1 wherein the stationary drum assembly further comprises means for opening the top cover.

6. The apparatus for grinding material of claim 1 wherein the rotating drum assembly further includes a stationary support wall surrounding said rotatable side wall for rotatably supporting said rotatable side wall.

7. The apparatus for grinding material of claim 6 wherein the means for rotating said rotatable side wall further comprises an endless roller chain affixed to said side wall and at least one motor affixed to said stationary side wall for engaging said roller chain for rotating said rotatable side wall.

8. The apparatus for grinding material of claim 7 wherein said motor is reversible for reverse rotation of said rotatable side wall.

9. The apparatus for grinding material of claim 2 which further comprises means for tilting the rotatable drum assembly, and stationary drum assembly, from a vertical position to a tilted position.

10. The apparatus for grinding material of claim 9 which further comprises means for shrouding the infeed opening to prevent material from passing out from the generally enclosed drum space from following a ballistic trajectory.

11. The apparatus for grinding material of claim 10 wherein the rotating drum assembly further includes a stationary support wall surrounding said rotatable side wall for rotatably supporting said rotatable side wall.

12. The apparatus for grinding material of claim 11 wherein the means for rotating said rotatable side wall further comprises an endless roller chain affixed to said side wall and at least on motor affixed to said stationary side wall for engaging said roller chain for rotating said rotatable side wall.

13. The apparatus for grinding material of claim 12 wherein said motor is reversible for reverse rotation of said rotatable side wall.

* * * * *